US005140929A

United States Patent [19]

Gaspard

[11] Patent Number: 5,140,929

[45] Date of Patent: Aug. 25, 1992

[54] HANDLING BOOM COMPRISING A MAIN BOOM AND AN ADDITIONAL BOOM

[75] Inventor: Bernard F. Gaspard, Montceau-les-Mines, France

[73] Assignee: PPM Zone Industrielle de la Saule, Montceau-les Mines, France

[21] Appl. No.: 690,093

[22] Filed: Apr. 23, 1991

[30] Foreign Application Priority Data

May 3, 1990 [FR] France ..... 90 05575

[51] Int. Cl.[5] ..... B66C 23/62

[52] U.S. Cl. ..... 212/270; 212/177

[58] Field of Search ..... 212/177, 182, 187, 188, 212/227, 230–232, 237, 238, 255, 223, 266, 264, 266–267, 166, 188, 266; 52/115–119, 637

[56] References Cited

U.S. PATENT DOCUMENTS

| | | | |
|---|---|---|---|
| 3,360,142 | 12/1967 | Jamison et al. | 214/130 |
| 3,430,778 | 3/1969 | Brown | 212/188 |
| 3,830,376 | 8/1974 | Fritsch | 212/144 |
| 4,053,058 | 10/1977 | Jensen et al. | 212/8 R |
| 4,091,936 | 5/1978 | Wuerflein et al. | 212/144 |
| 4,431,109 | 2/1984 | Behrendt et al. | 212/177 |
| 4,491,229 | 1/1985 | Behrendt et al. | 212/188 |
| 4,621,742 | 11/1986 | Rathi | 212/177 |
| 4,828,124 | 5/1989 | Iga | 212/266 |

FOREIGN PATENT DOCUMENTS

| | | |
|---|---|---|
| 0084981 | 8/1983 | European Pat. Off. . |
| 0254510 | 1/1988 | European Pat. Off. . |
| 2218275 | 9/1974 | France . |
| 2370677 | 6/1978 | France . |
| 8303816 | 11/1983 | PCT Int'l Appl. . |

*Primary Examiner*—Edwin L. Swinehart
*Attorney, Agent, or Firm*—Poms, Smith, Lande & Rose

[57] ABSTRACT

The invention relates to a handling boom comprising a main boom and an additional boom which is pivotally mounted relative to the main boom about a first axis, the additional boom comprising a support frame pivotally mounted on the main boom about a first axis and a manipulation jib pivotally mounted on the support frame about a horizontal second axis. According to the invention, the second pivot axis is disposed close to the top face of the additional boom in such a manner as to enable the manipulation jib to be pivoted upwards from a first deployed configuration of the additional boom. The invention is applicable to making a handling boom including a telescopic main boom and which is relatively lightweight and reliable.

7 Claims, 8 Drawing Sheets

FIG. 3D
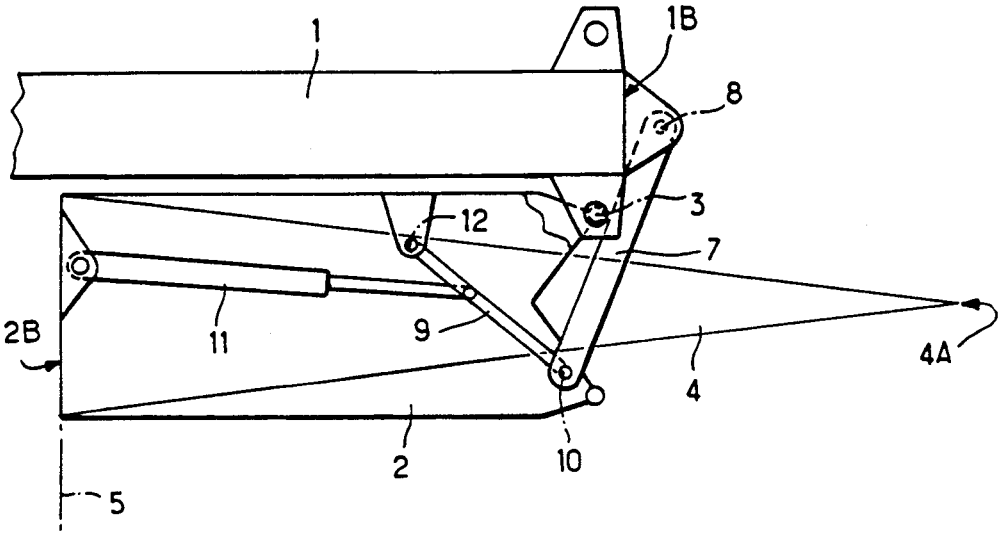
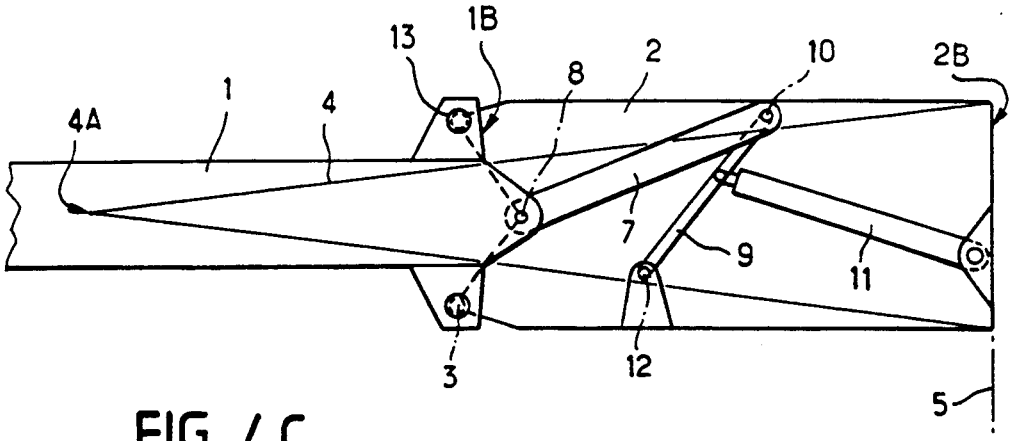
FIG. 4C

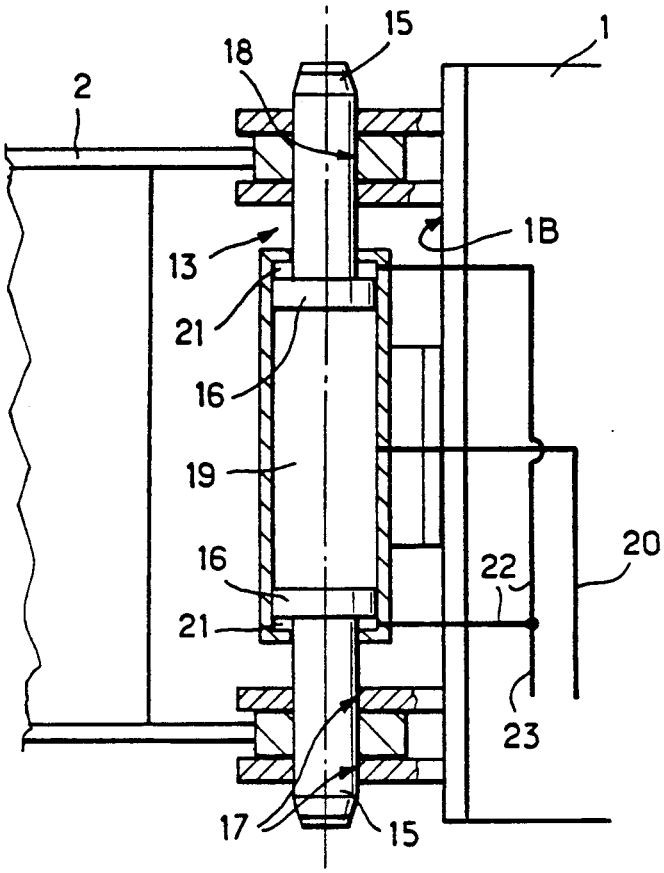
FIG. 6
FIG. 7
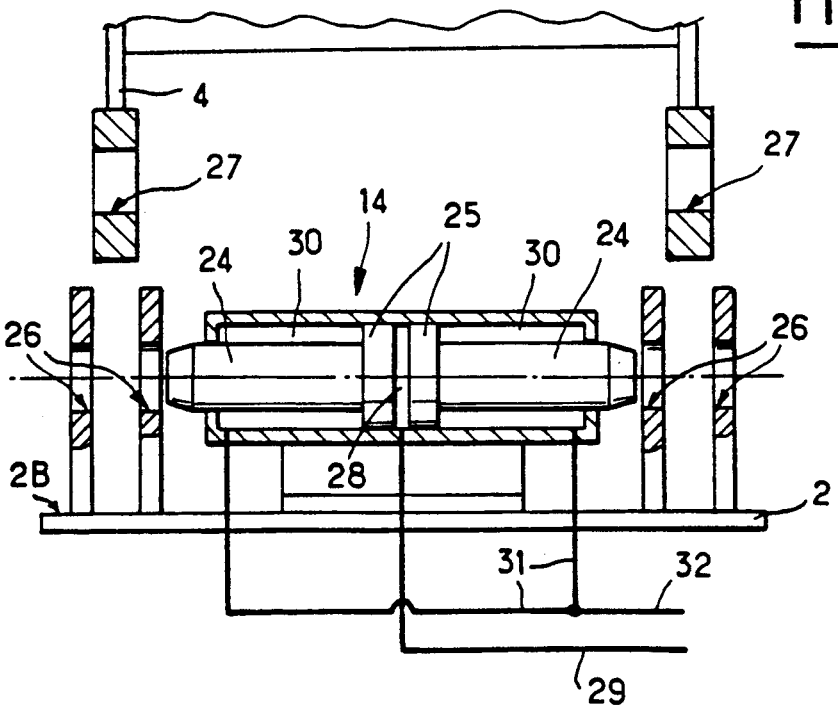

FIG. 9
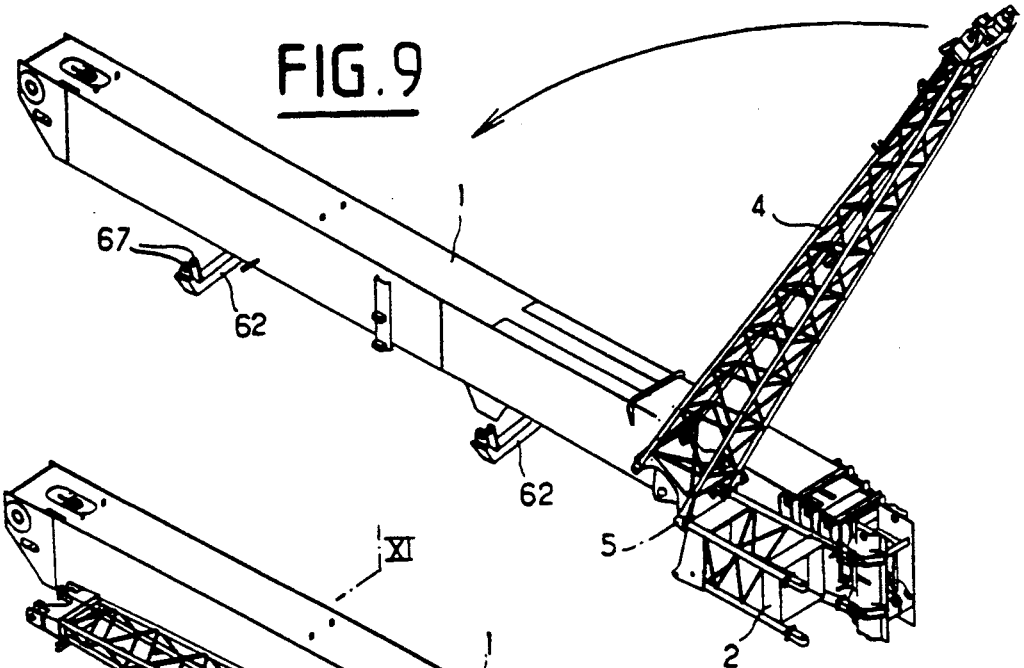
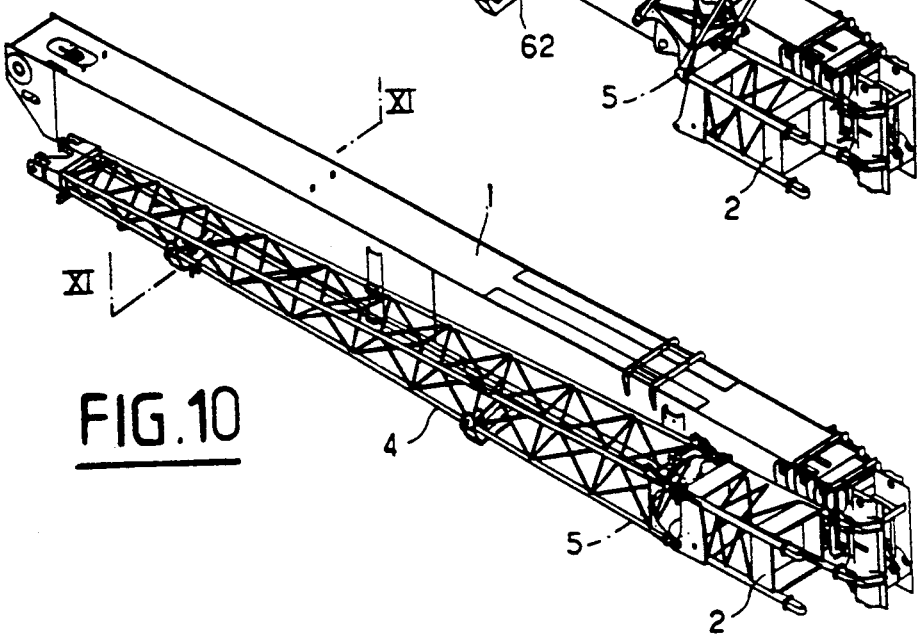
FIG. 10
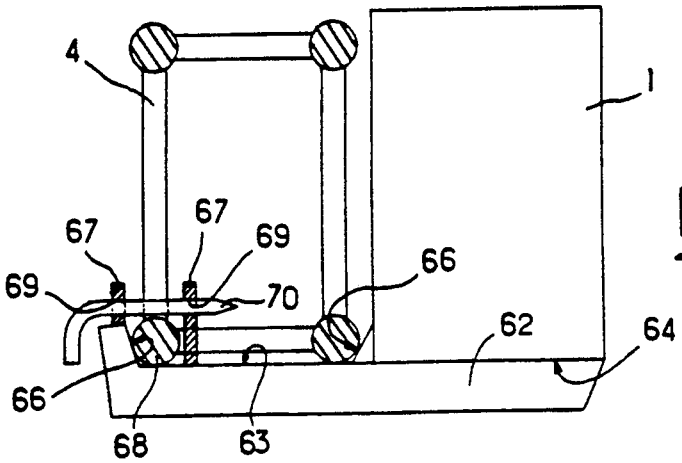
FIG. 11

HANDLING BOOM COMPRISING A MAIN BOOM AND AN ADDITIONAL BOOM

FIELD OF THE INVENTION

A known type of handling boom has the following structure:

a main boom extending along a main general direction and an additional boom extending along an additional general direction;

the additional boom being pivotally mounted relative to the main boom about a first pivot axis perpendicular to the main direction, thereby enabling it to take up two main positions, namely:

a first main position in which the additional boom extends back alongside the main boom, with said main and additional general directions being substantially parallel to each other and with the assembly of the main boom and the additional boom occupying its shortest length in the main direction; and a second main position in which the additional boom constitutes an extension of the main boom, the assembly then having its in-use greatest length in said main direction;

and the additional boom comprising:

a support frame pivotally mounted on and relative to the main boom about the first pivot axis; and a manipulation jib which extends along a jib general direction and which is pivotally mounted on and relative to the support frame about a second pivot axis which is substantially horizontal and orthogonal to said first pivot axis and to said jib general direction.

BACKGROUND OF THE INVENTION

EP-A-0 254 510 describes such a handling boom.

In the known prior art, the pivot axis between the manipulation jib and the support frame is placed close to the bottom face of the additional boom, thereby enabling downwards only folding of the additional boom when starting from the configuration in which its manipulation jib extends its support frame. Given the usual dimensions of cranes and of their handling booms, and given the need to avoid allowing the free end of the manipulation jib coming into contact with the ground, the jib can be folded relative to its support frame only when the additional boom is in configurations analogous to that shown in FIG. 2 of the above-mentioned European document, i.e. a configuration in which the first pivot axis is not vertical. As a result, a large force is required to swing the additional boom about said first pivot axis while the additional boom is in its folded configuration, and this force must necessarily be mechanical, e.g. it must be provided by powerful actuators.

In the context of a handling boom having the structure defined under the heading "Field of the Invention", the present invention seeks to make it possible for the first pivot axis to be vertical simultaneously with configurations in which the additional boom is folded, thereby making it possible to reduce the force required for swinging the folded boom about the first pivot axis to substantially the force required for overcoming friction.

SUMMARY OF THE INVENTION

According to the invention, this is done by said substantially horizontal second pivot axis being is disposed close to the top face of the additional boom in such a manner as to enable the manipulation jib to pivot upwards relative to the support frame about said second pivot axis, from a "deployed" first configuration of the additional boom in which the manipulation jib is disposed substantially in line with the support frame to a position in which the additional boom takes up a "folded" second configuration.

In addition, the following advantageous dispositions are preferably adopted:

the main boom is suitable for being placed in a special position in which said first pivot axis is substantially vertical such that while the main boom is indeed placed in said special position, the maximum clearance required by the additional boom as measured from said first pivot axis in a horizontal plane perpendicular to said first pivot axis corresponds to the folded configuration of the additional boom and is substantially smaller than the clearance corresponding to said additional boom being in its deployed configuration;

the ratio of said clearances required by the additional boom when in its said folded configuration to when in its said deployed configuration, is less than 0.20;

the handling boom includes a moving pin suitable for taking up a first position in which the manipulation jib is fixed to the support frame and a second position in which the manipulation jib is mounted to pivot freely about said second pivot axis relative to the support frame;

the pin is coupled to an actuator for adjusting its position;

the handling boom includes an actuator for adjusting the pivoting of the manipulation jib relative to the support frame, which actuator is coupled between said two components;

the main boom includes a support on which the manipulation jib bears when the additional boom is placed in said first main position, folded back alongside the main boom; and the handling boom includes a device for holding the manipulation jib pressed against said support.

The main advantage of a boom in accordance with the present invention lies both in its ease of use and in easier manufacture.

BRIEF DESCRIPTION OF THE DRAWINGS

Embodiments of the invention are described by way of example with reference to the accompanying drawings, in which:

FIGS. 3D and 4D are fragmentary plan views analogous to FIGS. 3A and 4A respectively showing a detail of the structure of the handling boom;

FIG. 6 shows the structure of the pin for locking the support frame of the additional boom relative to the main boom;

FIG. 7 shows the structure of the pin for locking the manipulation jib of the additional boom to the support frame;

FIGS. 9 and 10 are perspective views of a variant embodiment of the handling boom of FIG. 1, showing two distinct configurations of the handling boom; and FIG. 11 is a cross-section of the FIG. 10 goods-handling boom on plane XI-XI of FIG. 10.

DETAILED DESCRIPTION

Figure 1:
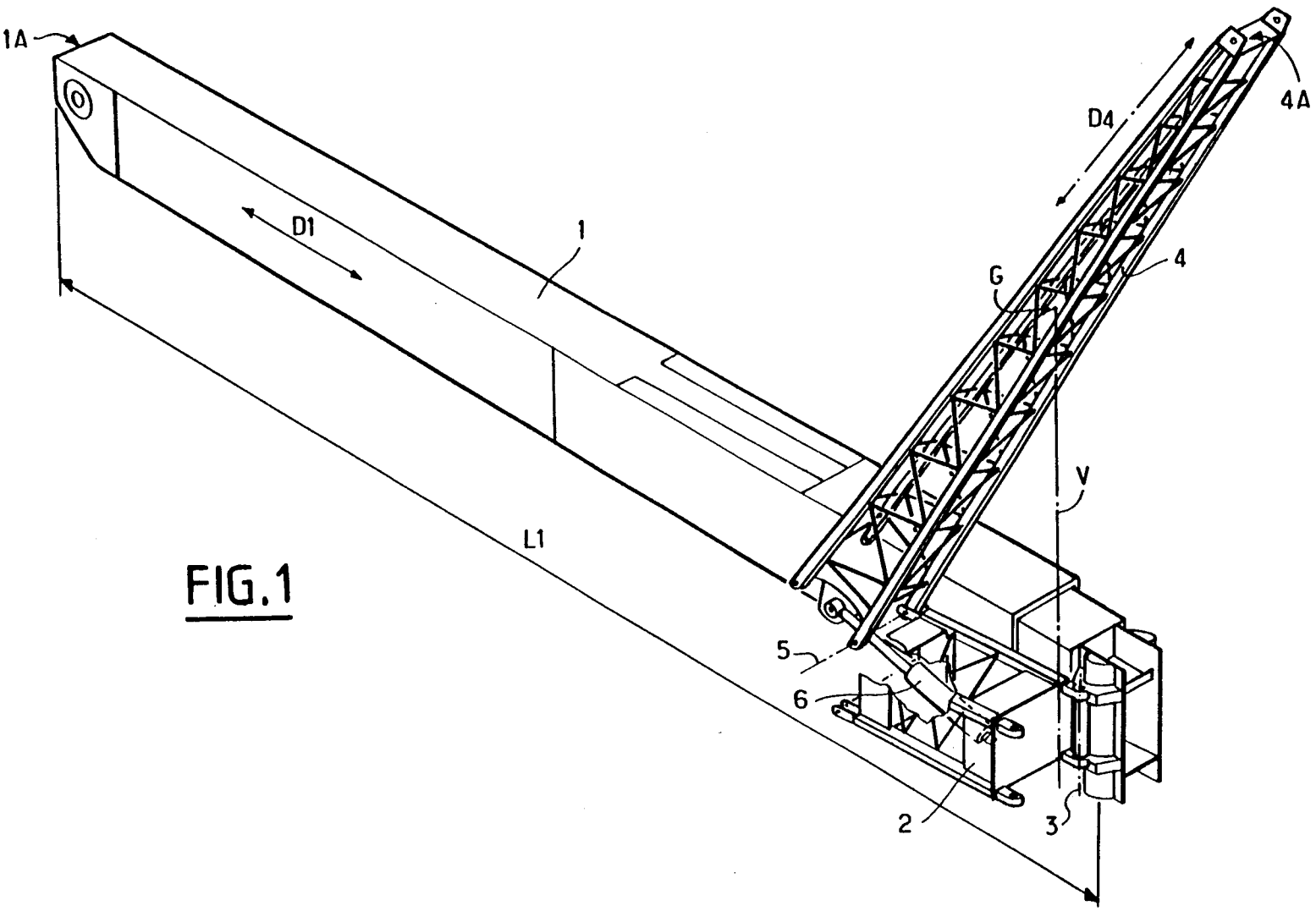
FIG. 1 is a perspective view of a handling boom of the invention.

The boom of FIG. 1 comprises:

a telescopic main boom 1 having length L1 in its non-extended configuration;

a support frame 2 pivotally mounted on the main boom about a pivot axis 3, the support frame 2 being directed towards the rear 1A of the main boom 1 in the configuration shown; and a manipulation jib 4 which is pivotally mounted on the support frame 2 about a pivot axis 5, with an actuator 6 being coupled between these two components to adjust their relative positions.

Figure 2A:
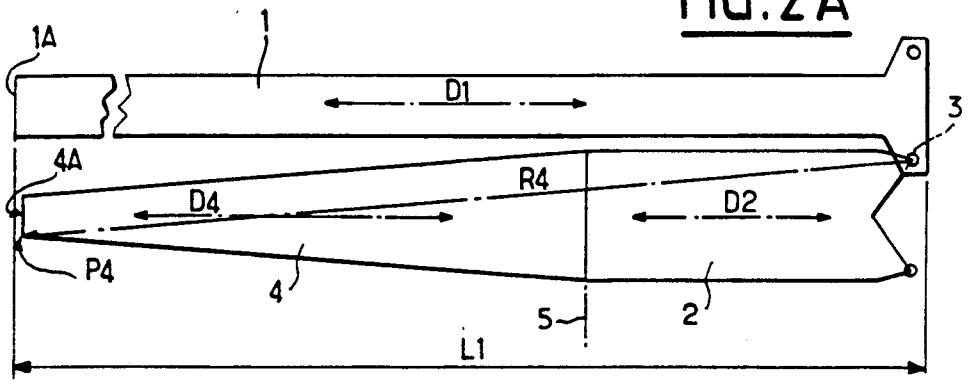
FIGS. 2A, 3A, 4A, and 5A are plan views of the FIG. 1 boom shown in four successive configurations.
Figure 2B:
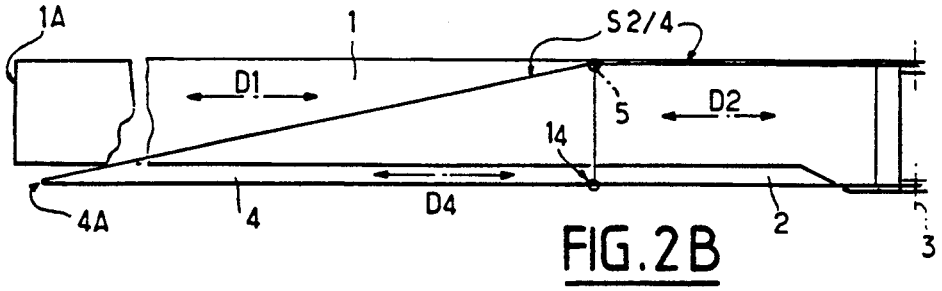
FIGS. 2B, 3B, 4B, and 5B are side views of the FIG. 1 boom shown in positions that correspond to FIGS. 2A, 3A, 4A, and 5A, respectively.

The manipulation jib 4 and the support frame 2 together constitute an additional boom 2–4 made up of two portions that are hinged to each other about the pivot axis 5 which lies substantially in the top face S 2/4 of the additional boom when in its deployed configuration (FIG. 2B). This position of the pivot axis 5 makes it possible to pivot the manipulation jib 4 upwards (FIG. 3B) relative to the support frame 2 starting from the configuration shown in FIG. 2B.

In the configuration of FIG. 1, as in the configurations of FIGS. 2B, 3B, 4B, and 5B, the main boom 1 is substantially horizontal. In this "folded" configuration of the additional boom (2–4) as shown in FIG. 1, the pivot axis 3 is vertical while the pivot axis 5 is horizontal and extends transversely relative to the main general direction D1 parallel to which the main boom 1 extends. The manipulation jib 4 is pointed upwards, with its free end 4A being placed in front of the pivot axis 5 so that the center of gravity G of the assembly constituted by the support frame 2 and the additional boom 4 lies on a vertical line V displaced a radius R from pivot axis 3, as shown in FIG. 3A.

In the "deployed" configuration of the additional boom 2–4, shown in FIGS. 2A and 2B, the additional general direction D4 of the manipulation jib 4 is parallel to the main direction D1, with the manipulation jib 4 pointing towards the rear 1A of the main boom 1. The additional boom constituted by the assembled support frame 2 and manipulation jib 4 is placed alongside the main boom 1 when in its out-of-use configuration, with the length of the assembly then being limited to the length L1 of the main boom 1. The general direction D2 of the support frame is parallel to the main direction D1.

Figure 3A:
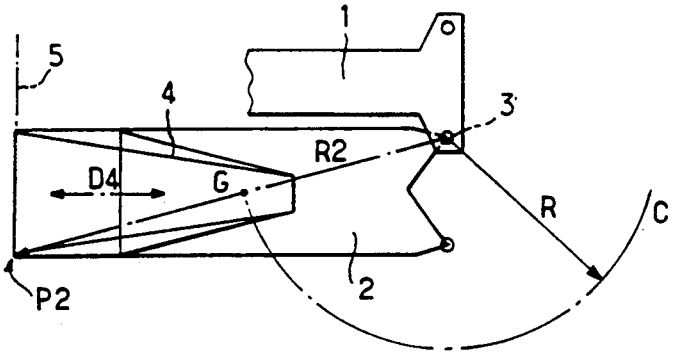
Figure 3B:
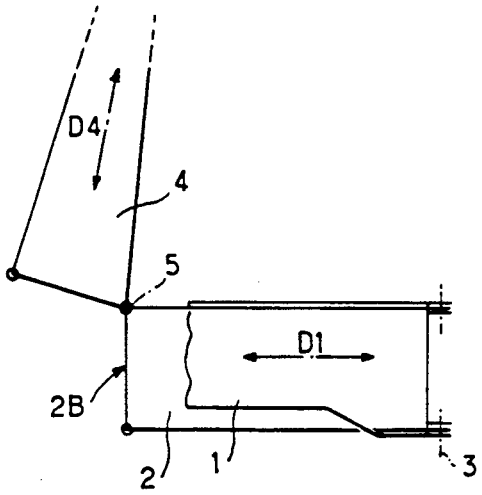

In the folded configuration of the additional boom (2–4) shown in FIGS. 3A and 3B, only the manipulation jib 4 has been displaced relative to the configuration of FIGS. 2A and 2B, with the jib being pivoted upwards about the horizontal pivot axis 5, so that the direction D4 is close to the vertical while sloping slightly towards the front of the main boom 1. Starting from this configuration, the support frame 2 can be swung about the vertical axis 3 to displace the assembled support frame 2 and manipulation jib 4 towards the configuration of FIGS. 4A and 4B.

Figure 4A:
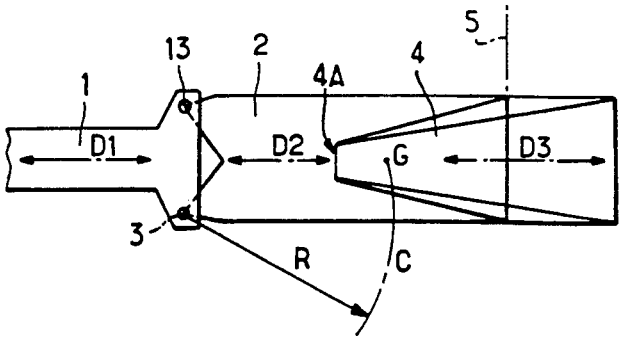
Figure 4B:
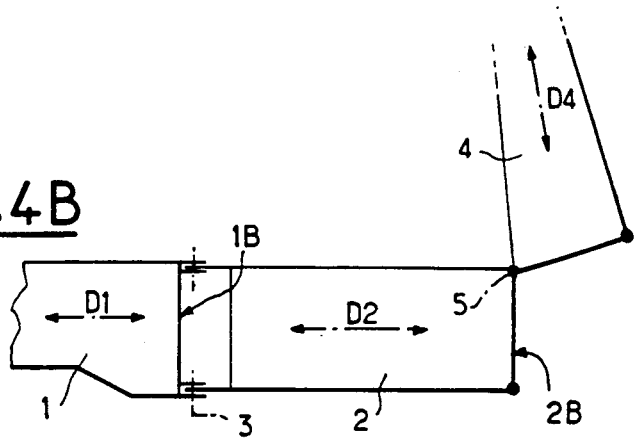

In the configuration of FIGS. 4A and 4B, the support frame 2 has swung through about 180° about the vertical pivot axis 3, and its general direction is again parallel to the direction D1 of the main boom 1 and substantially coincides therewith, the support frame 2 lying in line with the main boom 1, ahead of its front end 1B.

Figure 5A:
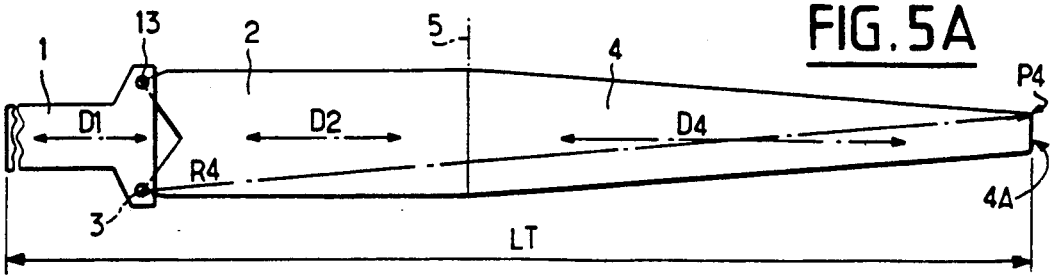
Figure 5B:
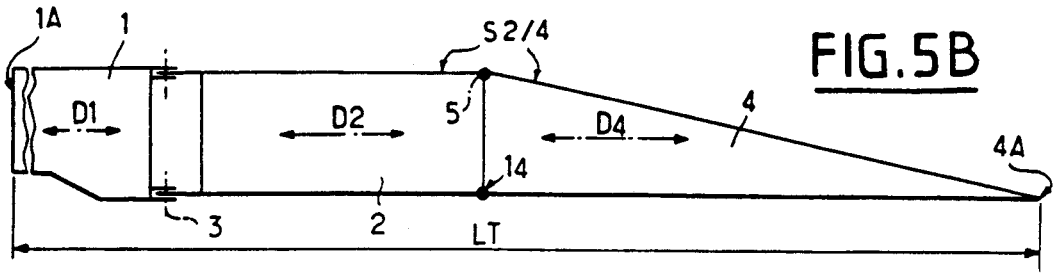

The manipulation jib 4 can then be pivoted back downward about horizontal pivot axis 5 so that it extends the support frame 2, as shown in the configuration of FIGS. 5A and 5B.

In the configuration of FIGS. 5A and 5B, the directions D1, D2, and D4 are aligned horizontally. The manipulation jib 4 again extends the support frame 2, after pivoting about the horizontal axis 5. The additional boom (2–4) is again in its deployed configuration. The total length LT of the equipment is equal to the sum of the lengths of the main boom 1 and of the additional boom constituted by the support frame 2 and the manipulation jib 4. This is the in-use configuration of the additional boom (2–4).

When going from the configuration of FIGS. 3A and 3B to configuration of FIGS. 4A and 4B the vertical line V on which the center of gravity G is located is displaced round a circle C of radius R centered on the pivot axis 3. The radius R is thus small, and in this example less than 1 meter (m), whereas in the prior art, when the manipulation jib 4 had to be displaced while remaining horizontal, the radius R could, in some booms, exceed 10 m.

Figure 2C:
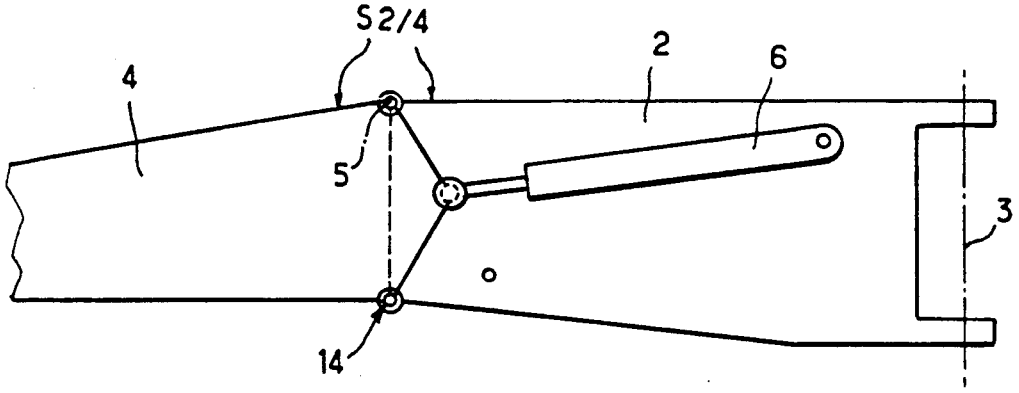
FIGS. 2C and 3C are fragmentary side views analogous to FIGS. 2B and 3B respectively, showing a detail of the structure of the handling boom.
Figure 3C:
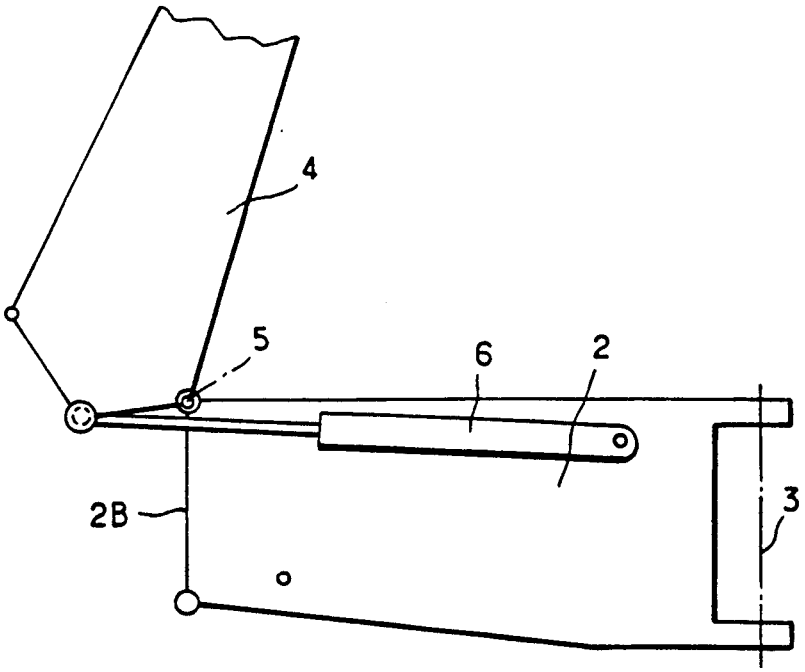

FIGS. 2C and 3C show the additional boom in side view in the same configurations as FIGS. 2B and 3B, respectively, and they also show the actuator 6 for controlling pivoting about the axis 5.

FIGS. 3D and 4C show the additional boom as seen from above in the same configurations as FIGS. 3A and 4A, respectively, together with the means for controlling swinging of the support frame 2 about the vertical pivot axis 3.

This controlling means comprises:

a link 7 pivotally mounted to the front end 1B of the main boom 1 about an axis 8;

a link 9 pivotally mounted to the side of the support frame 2 which has the pivot axis 3 going through one end thereof, the link being connected thereto about a pivot axis 12 about one third of the way along the side from said pivot axis 3, the links 7 and 9 also being connected to each other at their respective opposite ends about a pivot axis 10; and a control actuator 11 which is coupled between the link 9 and the end 2B of the support frame 2 which is opposite from the vertical pivot axis 3.

The end 2B of the support frame 2 close to where the pivot axis 5 for the manipulation jib 4 is disposed on said support frame is situated behind the front face 1B of the main boom 1 when in the configuration of FIG. 3D, and in front of this front face 1B when in the configuration of FIG. 4C.

When the additional boom (2–4) is in its in-use configuration (FIGS. 5A, 5B), it is desirable to prevent unintended pivoting about axes 3 and 5. This is achieved by means of pins 13 and 14 which penetrate into holes provided in parts that then overlie one another.

The pin 13 is disposed parallel to the pivot axis 3 for swinging the support frame 2 relative to the main boom. As shown in FIG. 6, pin 13 is constituted by two half-shafts 15 integral with pistons 16 belonging to two opposing actuators and suitable for penetrating into holes 17 formed at the front end 1B of the main boom 1, and holes 18 provided in the support frame 2. The actuators have a common chamber 19 which is connected to a duct 20 which, when fed with fluid under pressure, causes the half-shafts 15 to be extended and inserted in the holes 17 and 18, when these holes overlie one another (FIGS. 4A, 4C). In addition, each actuator has a chamber 21 opposite to the chamber 19 with the two chambers 21 being interconnected by a duct 22 which is itself connected to a duct 23.

The pin 14 is disposed parallel to the pivot axis 5 for holding the manipulation jib 4 relative to the support frame 2. As shown in FIG. 7, pin 14 is constituted by two half-shafts 24 integral with the pistons 25 of two oppositely-directed actuators and suitable for penetrating into holes 26 formed at the end 2B of the support frame and holes 27 formed in the manipulation jib 4. These actuators have a common chamber 28 which is connected to a duct 29 such that when the duct is fed with fluid under pressure, the two half-shafts 24 are extended and inserted into pairs of holes 26 and 27 so long as they are overlying one another (FIGS. 5B, 2B). Each actuator is also provided with a chamber 30 opposing the chamber 28 with the two chambers 30 being interconnected by a duct 31, itself connected to a duct 32.

Figure 8:
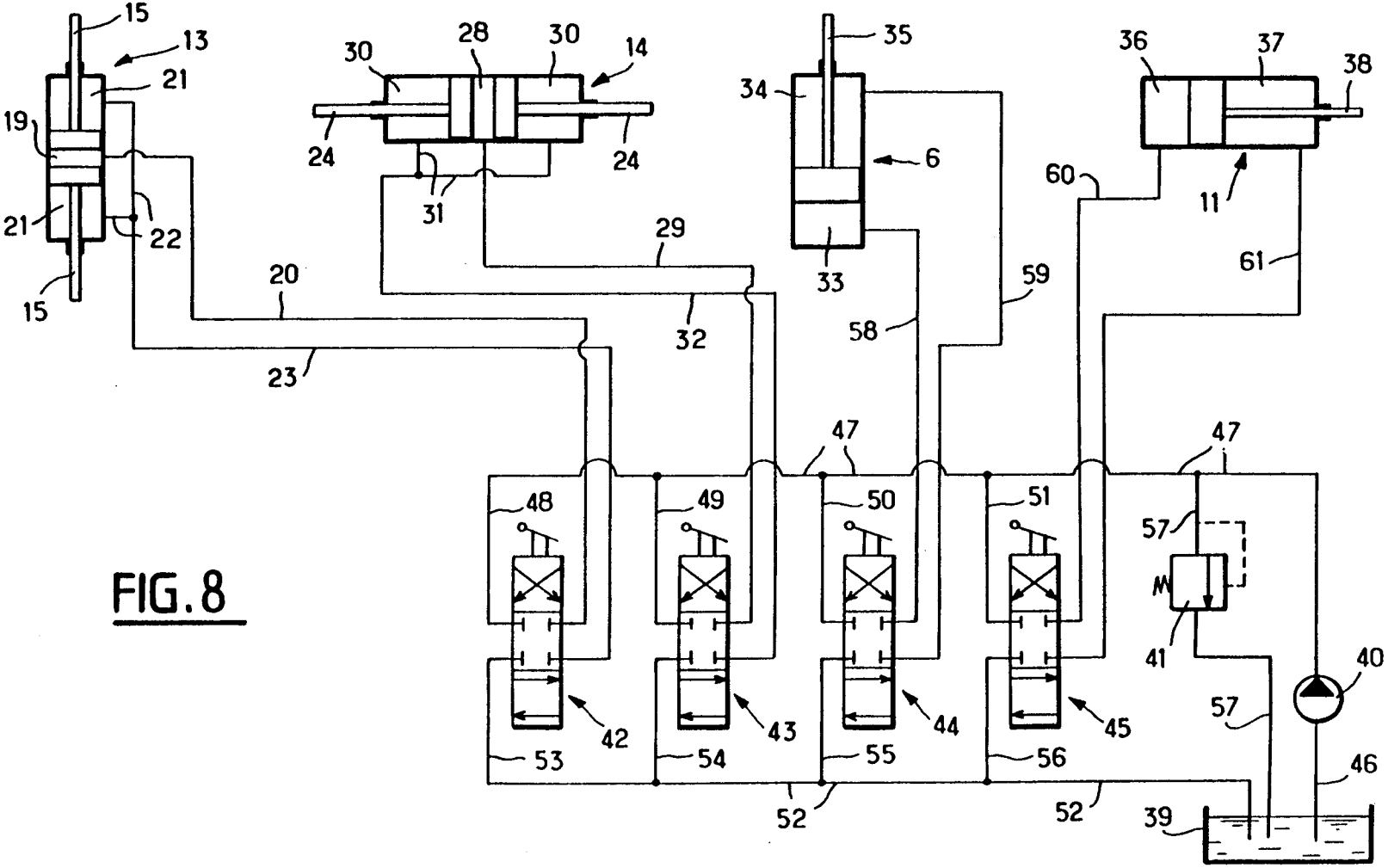
FIG. 8 is a diagram of the circuit for controlling the handling boom.

The control circuit of FIG. 8 also includes the following:

the actuator 6 which possesses a chamber 33 of large working section and a chamber 34 of small working section, with hydraulic feed to the large working section chamber 33 causing the piston rod 35 to be extended, thereby tilting the manipulation jib 4 from the configuration of FIG. 2C towards the configuration of FIG. 3C;

the actuator 11 which has a chamber 36 of large working section and a chamber 37 of small working section, with hydraulic feed to the large working section chamber 36 causing the piston rod 38 to be extended and pivoting the support frame 2 from the configuration of FIG. 4C towards the configuration of FIG. 3D;

a fluid tank 39;

a hydraulic pump 40;

a discharge valve 41 rated against excess pressure; and four three-position fluid distributor valves 42, 43, 44, and 45.

The circuit also includes the following ducts:

the suction duct 46 of the pump 40 connecting the pump to the fluid tank 39;

the delivery duct 47 of said pump 40;

ducts 48, 49, 50, and 51 connecting respective fluid distributor valves 42, 43, 44, and 45 to the delivery duct 47;

a return duct 52 going back to the fluid tank 39;

ducts 53, 54, 55, and 56 connecting respective fluid distributor valves 42, 43, 44, and 45 to the return duct 52;

a duct 57 which connects the delivery duct 47 to the fluid tank 39 and which includes the discharge valve 41;

the ducts 20 and 23 which are connected to fluid distributor valve 42;

the ducts 29 and 32 which are connected to fluid distributor valve 43;

ducts 58 and 59 which are connected firstly to respective chambers 33 and 34 of the actuator 6 and secondly to fluid distributor valve 44; and ducts 60 and 61 which are connected firstly to respective chambers 36 and 37 of the actuator 11 and secondly to fluid distributor valve 45.

The three positions of distributor valve 42 are as follows:

a first position putting the ducts 23 and 53 into communication and also the ducts 20 and 48;

a second position closing the ducts 20, 23, 48, and 53; and a third position putting the ducts 23 and 48 into communication and also the ducts 20 and 53.

Valve 42 enables the operator to actuate pin 13. The first position permits fluid from tank 39 to be pumped through ducts 48 and 20 into common chamber 19 of pin 13, while fluid is exhausted from chambers 21 through ducts 23 and 53 back to tank 39, thus causing half shafts 15 to extend. The second position locks pin 13 in either the retracted or extended position. The third position reverses the flow of fluid, so that fluid is pumped back into chambers 21 and exhausted from common chamber 19, to retract half shafts 15.

The three positions of distributor valve 43 are as follows:

a first position putting the ducts 29 and 49 into communication and also the ducts 32 and 54;

a second position closing the ducts 29, 32, 49, and 54; and a third position putting the ducts 29 and 54 into communication and also the ducts 32 and 49.

As above, valve 43 enables the operator to actuate pin 14. The first position permits fluid from tank 39 to be pumped through ducts 49 and 29 into common chamber 28 of pin 14, while fluid is exhausted from chambers 30 through ducts 32 and 54 back to tank 39, thus causing half shafts 24 to extend. The second position locks pin 14 in either the retracted or extended position. The third position reverses the flow of fluid, so that fluid is pumped back into chambers 30 and exhausted from common chamber 28, to retract half shafts 24.

The three positions of distributor valve 44 are as follows:

a first position putting the ducts 58 and 55 into communication and also the ducts 59 and 50;

a second position closing the ducts 58, 59, 50, and 55; and a third position putting the ducts 58 and 50 into communication and also the ducts 59 and 55.

As above, valve 44 enables the operator to actuate actuator 6. The first position permits fluid from tank 39 to be pumped through ducts 50 and 58 into chamber 33 of actuator 6, while fluid is exhausted from chamber 34 through ducts 59 and 55 back to tank 39, thus causing rod 35 to extend. The second position locks actuator 6 in either the retracted or extended position. The third position reverses the flow of fluid, so that fluid is pumped back into chamber 34 and exhausted from chamber 33, to retract rod 35.

The three positions of distributor valve 45 are as follows:

a first position putting the ducts 60 and 51 into communication and also the ducts 61 and 56;

a second position closing the ducts 60, 61, 51, and 56; and a third position putting the ducts 60 and 56 into communication and also the ducts 61 and 51.

As above, valve 45 enables the operator to actuate actuator 11. The first position permits fluid from tank 39 to be pumped through ducts 51 and 60 into chamber 36 of actuator 11, while fluid is exhausted from chamber 37 through ducts 61 and 56 back to tank 39, thus causing rod 38 to extend. The second position locks actuator 11 in either the retracted or extended position. The third position reverses the flow of fluid, so that fluid is pumped back into chamber 37 and exhausted from chamber 36, to retract rod 38.

The variant of FIGS. 9 to 11 shows a handling boom identical in structure to that shown in FIG. 1, but having additional means added thereto.

This variant thus comprises a telescopic main boom 1, and an additional boom 2–4 itself comprising a support frame 2 pivotally mounted on the main boom 1 about a pivot axis 3 together with a manipulation jib 4 pivotally mounted on the support frame 2 about the pivot axis 5, in a structure having the same characteristics as already decribed with reference to above FIGS. 1 to 8.

In addition, there are two manipulation jib supports 62 projecting sideways from one side of the main boom 1, with the top faces 63 of the supports lying substantially flush with the face 64 of the main boom 1 that constitutes the bottom face of said main boom when said main boom is substantially horizontal. The manipulation jib 4 can be supported by these supports 62 which project far enough to be able to receive said manipulation jib. In addition, the top face 63 of each support 62 is delimited by two sloping edges 66 for holding the manipulation jib 6 in a position where it is locked against the supports 62. Finally, the end of each support is formed to have two plates, 67 suitable for receiving an upright 68 on the manipulation jib 4, with each plate 67 including a hole for receiving a removable rod 70 that prevents the upright 68 from being removed from between the two plates 67 between which it is received. Thus, when the manipulation jib 4 is stored along the main boom 1, the supports 62 support it while the holes 69 in the plates 67 and the rod 70 lock it in this storage configuration.

Each of the above-described handling booms includes a main telescopic boom 1 associated with an additional boom 2–4 and constitutes the handling equipment of a mobile crane. Although this particular structure provides a good solution for problems associated with the overall size and weight of a mobile crane fitted with a telescopic main boom, it should nevertheless be observed that such a structure may be adopted in making stationary cranes and that the main boom need not necessarily be telescopic. The advantages of the structure are appreciated and looked for in any type of crane and/or main boom on which an additional boom 2–4 is mounted.

When the additional boom 2–4 is to be deployed relative to the main boom 1 (by going from the configuration shown in FIGS. 2A and 2B to that shown in FIGS. 5A and 5B), and back again, the space required in a horizontal plane is the space required for swinging the support frame 2 from its FIG. 3A configuration to its FIG. 4A configuration, as measured by the radius of gyration R2 between the pivot axis 3 and the point P2 on the support frame 2 that is furthest from the pivot axis 3, whereas previously, when the additional boom 2–4 was in a single piece, without a folding pivot axis 5, the radius of gyration was measured by the distance R4 between the pivot axis 3 and the end P4 of the manipulation jib 4, in the configurations of FIGS. 2A and 5A. Normally the following lengths apply:

R2 in the range 1 m to 2 m; R4 in the range 10 m to 20 m.

The invention's novelty lies in obtaining a ratio of R2/R4 which is less than 0.2. It can be seen from FIGS. 2A and 3A that the horizontal area defined by a circle having the radius R4, would be significantly less than the corresponding circle drawn by radius R2. This reduced horizontal area enables the crane operator to swing the additional boom to the extended configuration of FIG. 2A in far less space than that required by conventional cranes.

The advantage of reducing the space requirement can be seen by comparing figures: whereas it is often possible to swing handling equipment round in a space having a radius of 1 m to 2 m, it is in contrast often impossible to swing it round when the required radius reaches or exceeds 10 m. There simply is not enough room.

Since it is possible to place the additional boom 2–4 in its folded configuration (FIGS. 3A, 3B) while retaining a vertical pivot axis 3 (in association with a substantially horizontal main boom 1), it is possible to swing the additional boom 2–4 about said pivot axis 3, between the configurations of FIGS. 3A–3B and 4A–4B merely by overcoming the friction forces about the pivot axis 3, thus by using forces that may be very small.

The problem of the overhanging center of gravity G is different from the problem of ensuring enough space, however on investigation comparable results are obtained. Reducing the radius of the circle C travelled by the center of gravity G from 10 m to 1 m clearly considerably reduces the torsion and bending stresses that the main boom 1 needs to be able to withstand while the support frame 2 and the manipulation jib 4 are being swung between the configurations of FIGS. 3A and 4A.

There are two advantages of the reduction in bending and torsion stress on main boom 1: first, the risk of deformation of the main boom 1 is significantly reduced; and second, a lighter weight main boom 1 can be used than which would be found in common use in the art. Here again, the advantage is significant.

Naturally the various actuators that are provided, together with their control circuits, make the maneuvers of deploying and folding the additional boom 2–4 easy.

Finally, the fact that the manipulation jib 4 pivots upwards (FIG. 3B) about the pivot axis 5 from the configuration in which it lies alongside and parallel to the main boom 1 (FIG. 2B), makes it possible to fold it up simply by removing the position retaining rods 70 (FIG. 11) and without there being any need to perform complex clearance movements relative to the main boom 1.

Similarly, when replacing the manipulation jib 4 alongside the main boom 1, it merely needs lowering from the configuration of FIG. 3B to that of FIG. 2B, by pivoting about the axis 5 and until it is supported by the supports 62. Such simple movements cannot be performed with manipulation jibs that pivot downwards relative to the support frame 2 and the main boom 1.

The invention is not limited to the embodiments described and shown, but on the contrary covers any variant that may be applied thereto without going beyond the scope or the spirit of the claims.

I claim:

1. A handling boom comprising a main boom extending along a main general direction and an additional boom extending along an additional general direction;

said additional boom being pivotally mounted to said main boom about a first pivot axis perpendicular to said main direction, said additional boom pivoting between a first main position wherein said additional boom extends parallel to said main boom, and a second main position wherein said additional boom constitutes an extension of said main boom, said main and additional general directions being adjacent to and substantially parallel to each other at said first position;

said additional boom further comprising:

a support frame pivotally mounted to said main boom about said first pivot axis; and a manipulation jib extending along a jib general direction, said manipulation jib being pivotally mounted to said support frame about a second pivot axis, said second pivot axis being disposed in an upper face of said additional boom, and substantially horizontal and orthogonal to said first pivot axis and to said jib general direction, said manipulation jib capable of pivoting between a deployed position wherein said manipulation jib constitutes an extension of said support frame, to an upright position wherein said jib extends substantially upward relative said support frame and said jib general direction is substantially vertical and perpendicular to said support frame, said manipulation jib being in said upright position only during manipulation of said additional boom between said first main position and said second main position.

2. A handling boom according to claim 1, wherein said manipulation jib has a length which is substantially longer than a corresponding length of said support frame such that a maximum radial clearance required by said additional boom as measured from said first pivot axis in a horizontal plane perpendicular to said first pivot axis with said manipulation jib in said upright position is substantially smaller than clearance corresponding to said additional boom having said manipulation jib in said deployed position.

3. A handling boom according to claim 2, wherein a ratio of said clearances required by said additional boom when said manipulation jib is in said upright position compared to said deployed position is less than 0.20.

4. A handling boom according to claim 1 further comprising a first moving pin taking up a first position in which said support frame is fixed to said main boom and a second position in which said support frame is enabled to pivot freely about said first pivot axis relative to said main boom.

5. A handling boom according to claim 4, further comprising a second moving pin taking up a first position in which said manipulation jib is held fast to said support frame and a second position in which said manipulation jib is allowed to pivot freely relative to said support frame about said second pivot axis.

6. A handling boom according to claim 1, wherein said main boom further comprises a support on which said manipulation jib bears when said additional boom is placed in said first main position extending back alongside said main boom.

7. A handling boom according to claim 6, further comprising means for retaining said manipulation jib against said support.

* * * * *